US006427281B1

(12) United States Patent
Simon

(10) Patent No.: US 6,427,281 B1
(45) Date of Patent: Aug. 6, 2002

(54) WALL MOUNTED BATH BRUSH

(76) Inventor: James S. Simon, P.O. Box 726, Tiburon, CA (US) 94920

( * ) Notice: Subject to any disclaimer, the term of this patent is extended or adjusted under 35 U.S.C. 154(b) by 0 days.

(21) Appl. No.: 09/490,027

(22) Filed: Jan. 21, 2000

(51) Int. Cl.[7] ..... A47K 7/02; A47K 7/06

(52) U.S. Cl. ..... 15/160; 4/606; 601/136; D4/130; D28/63

(58) Field of Search ..... 15/104.92, 160; 4/606; 601/136; D4/119, 120, 127, 130; D28/63

(56) References Cited

U.S. PATENT DOCUMENTS

| | | | | |
|---|---|---|---|---|
| 1,372,412 A | * | 3/1921 | Finkhousen | 15/160 |
| 1,437,794 A | * | 12/1922 | Cleveland | 15/160 X |
| 2,641,013 A | * | 6/1953 | Hesselgesser | 15/160 |
| 3,543,747 A | * | 12/1970 | Gustafson | 15/104.92 X |
| 3,631,560 A | | 1/1972 | Atkins | 15/146 |
| 3,750,226 A | | 8/1973 | Morgan | 15/187 |
| 4,020,519 A | | 5/1977 | Robison | 15/104.92 |
| 4,184,221 A | | 1/1980 | Edwards | 15/114 |
| 4,417,362 A | | 11/1983 | Walker | 4/606 |
| D275,236 S | | 8/1984 | Soderback | D28/63 |
| 4,617,917 A | * | 10/1986 | Miller | 15/104.92 X |
| 4,759,091 A | | 7/1988 | Kiss | 15/105 |
| D330,977 S | | 11/1992 | Otis | D4/125 |
| D332,178 S | | 1/1993 | Proctor et al. | D4/119 |
| 5,211,494 A | | 5/1993 | Baijnath | 401/28 |
| 5,228,165 A | | 7/1993 | Westberry et al. | 15/160 |
| 5,517,705 A | | 5/1996 | Jackson | 4/606 |
| 5,588,160 A | | 12/1996 | Nichols | 4/606 |

FOREIGN PATENT DOCUMENTS

| | | | | |
|---|---|---|---|---|
| DE | 300257 | * | 8/1917 | 15/160 |
| SU | 645644 | * | 2/1979 | 15/104.92 |

* cited by examiner

*Primary Examiner*—Mark Spisich
(74) *Attorney, Agent, or Firm*—Morrison & Foerster LLP

(57) ABSTRACT

A bath brush assembly is detachably mountable to a wall of a shower or bathtub. The bath brush assembly includes a frame and a bore extending therethrough. A plurality of bristles are attached to the frame and extend into the bore such that a stroke victim or handicapped person may clean one of their appendages by moving their appendage against the bristles.

3 Claims, 3 Drawing Sheets

WALL MOUNTED BATH BRUSH

TECHNICAL FIELD

The present invention is generally directed to brushes for bathing and more particularly to wall mounted bath brushes.

BACKGROUND ART

Various brushes exist for bathing the human body. A number of those brushes are wall mounted and removably attachable. One such brush assembly is disclosed in U.S. Pat. No. 4,759,091 to Kiss. The brush assembly of the '091 Patent is attachable to a wall and has a pair of spaced-apart elongated brushes mounted on a base. A hanger engages a bath or shower wall member and includes a hook for insertion within an opening in the base. Wall attachment is by suction cups on the rear side of the base with a lever provided for urging the base away from the supporting wall surface and facilitating return of the brush assembly to a stowed position. A double-sided adhesive may be used to permanently secure the base to a wall surface.

Another wall mounted bath brush and method is disclosed in U.S. Pat. No. 5,228,165 to Westberry et al. The '165 Patent discloses a brush for scrubbing and scratching the human body. The '165 brush includes a plate portion having a front face and a rear face, a plurality of bristles extending from the front face, and an attachment mechanism for attaching the brush to a wall. The attachment mechanism preferably provides removable attachment to a wall, and may be a plurality of suction cups. The front face of the plate portion preferably has essentially the same surface area as an average person's back and its outer edges of the front face optionally have the essential outline of the upper human torso. The bristles, provided in clusters, optionally have a stiffness and end roundable suitable for comfortably scratching a person's back when dry.

Other wall attachable brushes and sponges are disclosed in U.S. Pat. Nos. 4,417,362; 4,020,519; 3,631,560 and 3,750,226. Apparently, for one or more reasons, the disclosed arrangements have not found wide acceptance with the public as they do not appear to be readily available in retail establishments. None of the references appear to disclose a bath brush having a central bore with a plurality of bristles extending therein.

It is an advantage of the present invention to provide a bath brush which does not require the bather to twist and contort to scrub.

It is another advantage of the present invention to provide such a bath brush which can be detachably fixed to a shower wall.

It is still another advantage of the present invention to provide such a brush that is adapted to wash an arm of a handicapped person or stroke victim who lacks the use of both arms.

It is still another advantage of the present invention to provide such a brush which is simple, durable and inexpensive to produce.

SUMMARY OF THE PRESENT INVENTION

A bath brush assembly and method are provided for scrubbing an appendage, such as a limb, of a handicapped person or stroke victim. The bath brush assembly is wall-mounted and has a frame with a bore extending therethrough. A plurality of bristles are attached to the frame and extend into the bore. The frame may have various shapes and be formed of modular components. Joined to the frame are a number of suction cups which provide a detachable connection to the wall of a shower or bathtub.

BRIEF DESCRIPTION OF THE DRAWINGS

Various other features and advantages of the invention will become apparent to those skilled in the art from the following discussion taken in conjunction with the following drawings, in which.

DETAILED DESCRIPTION OF THE PREFERRED EMBODIMENTS

Figure 1A:
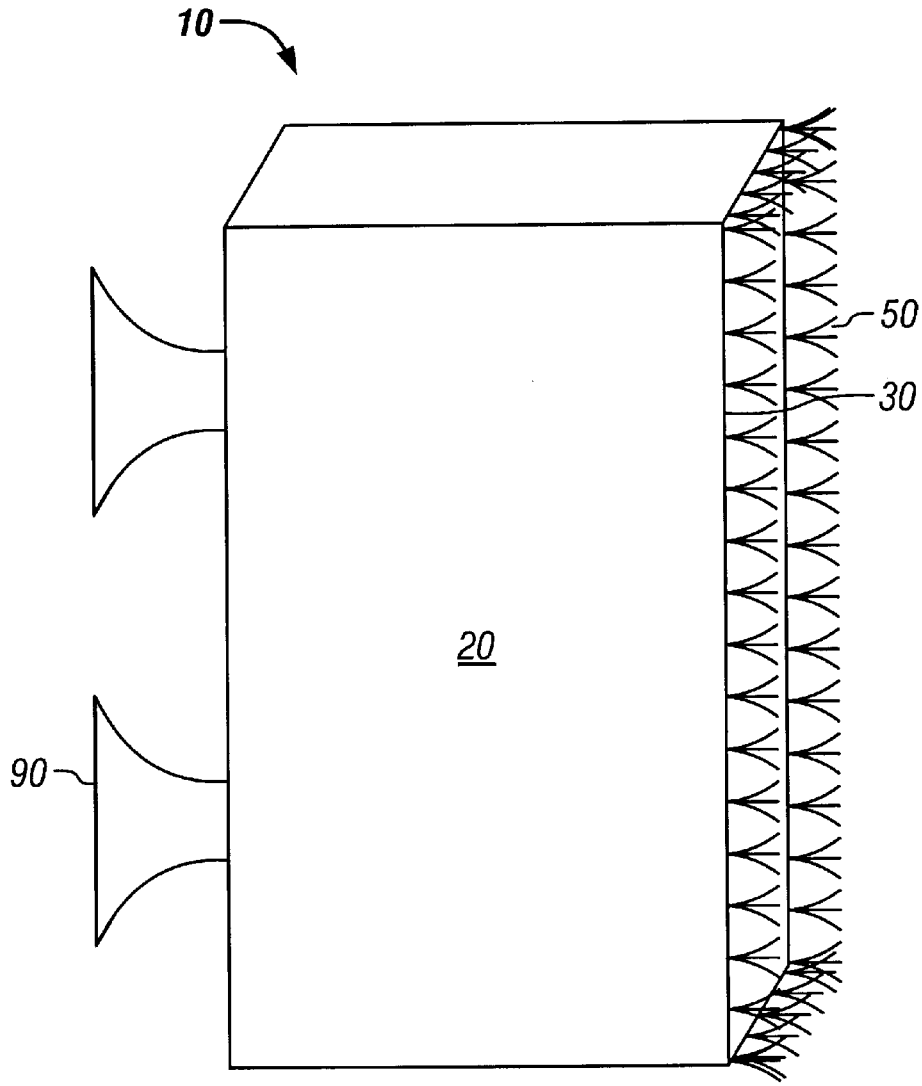
FIG. 1A is a perspective view of a bath brush in accordance with the present invention.
Figure 1B:
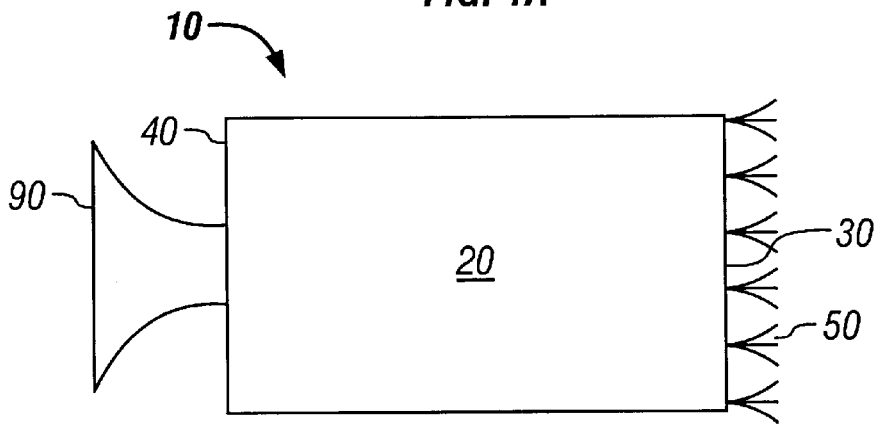
FIG. 1B is a top view of the embodiment shown in FIG. 1A.

Referring to FIG. 1A, a bath brush 10 is disclosed. Bath brush 10 has a cartridge 20. The cartridge 20 of bath brush 10 has a front surface 30 as well as a rear surface 40 (FIG. 1B). The cartridge 20 is preferably made of a polymeric material.

As shown in FIG. 1, the cartridge 20 has a flat cubical or rectangular shape. The cartridge 20, however, may have other shapes including, for example, a semi-spherical or dome shape. Additionally, the front surface 30 is not required to be flat. The front surface may have, for example, a concave, convex, or other shape (not shown).

Referring to FIG. 1A, a plurality of bristles 50 are shown extending from the front surface 30. The bristles may be, for example, a polymer fiber, or other material suitable for bath brushes. The bristles 50 may be attached to the front surface 30 by, for example, adhesives, heat bonds, epoxy, or press-fitting.

The bath brush of FIG. 1A also shows two suction cups 90 extending from the rear surface 40 for gripping or fastening to a wall of the shower or bath tub. Although only two suction cups are shown, more may be employed. The number and size of the suction cups may be increased to ensure that the brush assembly stays affixed to the wall during use. The suction cups 90 may be joined to the rear surface 40 using adhesives, screws, or ties such as, for example, a wire tie.

Figure 2:
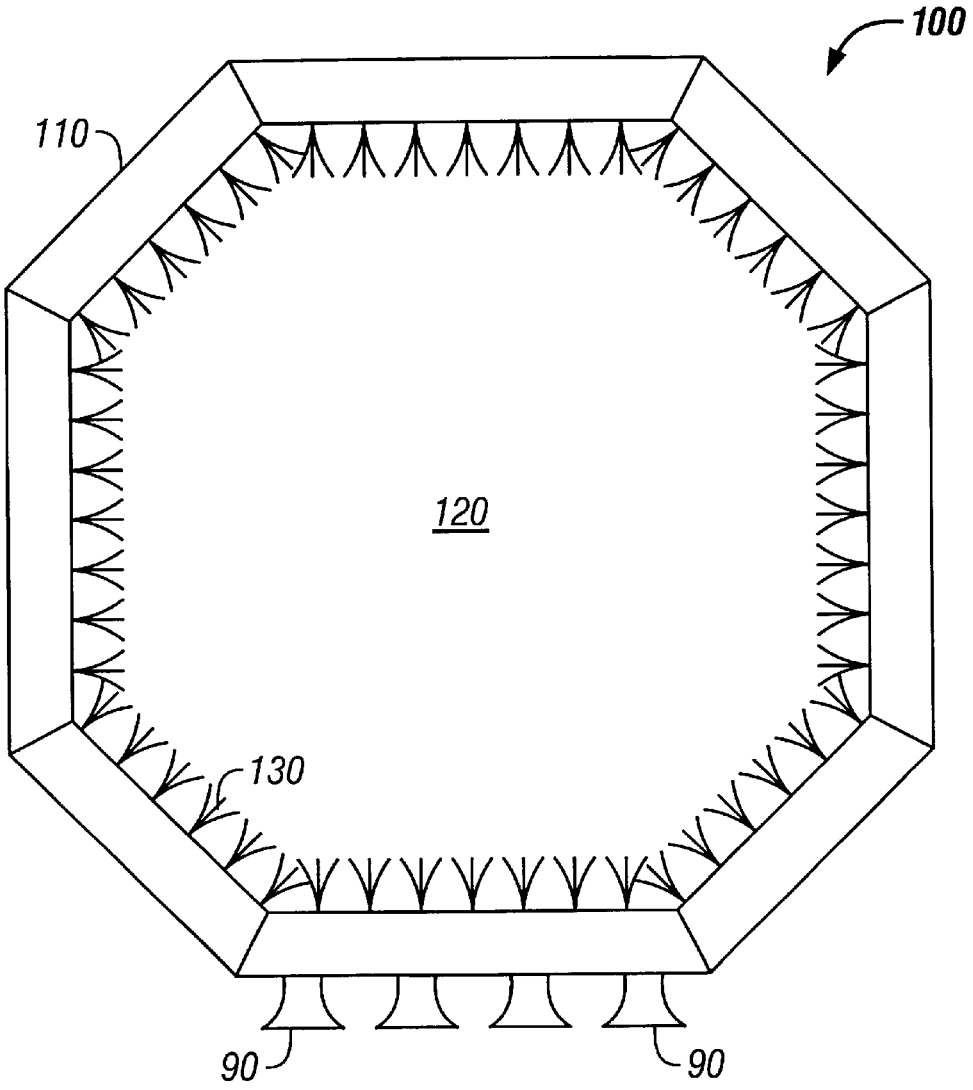
FIG. 2 is a top view of another embodiment of the present invention.

FIG. 2 shows another bath brush assembly in accordance with the present invention. The bath brush assembly 100 has a frame 110. The bath brush assembly 100 further comprises a bore 120 extending through the frame 110. Extending into the bore 120 are a plurality of bristles 130. The bristles 130 are the same as those described in the previous embodiments and extend from an inner surface of the frame 110.

The frame 110 is preferably made of plastic. The frame 110 may be integral or be composed of modular components. If the frame 110 is comprised of modular components, the modular components may be identical to one another and glued together using, for example, an adhesive or epoxy.

Figure 3:
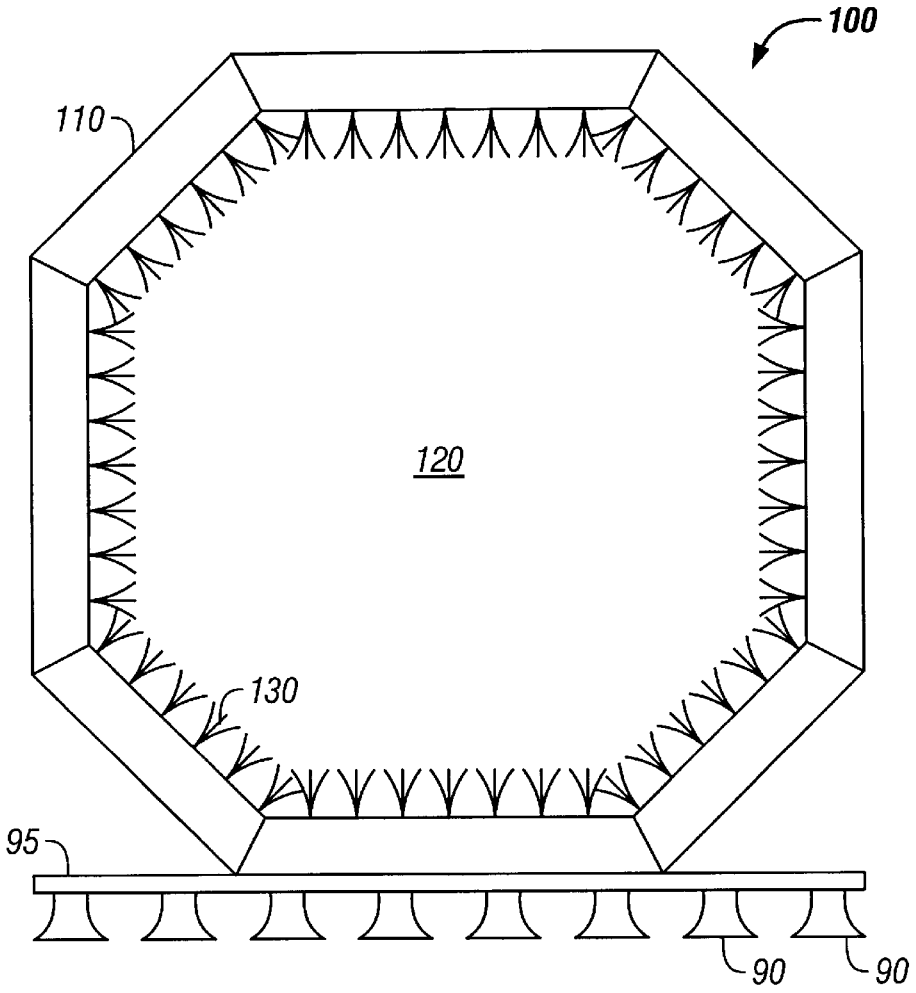
FIG. 3 is a top view of another embodiment of the present invention.

FIG. 3 shows another aspect of a bath brush assembly in accordance with the present invention. In FIG. 3, a support member 95 is shown joined to frame 110. The support member 95 provides a larger surface for the suction cups 90. Thus, more suction cups 90 may be employed in the bath brush assembly 100 of FIG. 3 than the bath brush assembly of FIG. 2. The additional suction cups provide enhanced gripping force and ensure that the bath brush assembly will stay affixed during operation.

The support member may be made of, for example, plastic. The support member may be attached to the frame 110, for example, using various bonding or fastening techniques. Examples of bonding techniques are adhesive bonds or heat bonds. Alternatively, the support member may be attached to frame 110 with a fastener such as, for example, screws or rivets.

In operation, the bath brush assembly 100 may be used for bathing and scrubbing an appendage such as a leg or arm of a handicapped person or stroke victim. A handicapped person, for example, simply inserts her arm through the bore 120. The handicapped person moves her arm against the bristles 130 to scrub her arm. In this manner, a handicapped person with use of only one arm may clean her arm without assistance.

While the invention has been described, disclosed, illustrated and shown in various terms for certain embodiments or modifications which it has assumed in practice, the scope of the invention is not intended to be, nor should it be deemed to be, limited thereby, and such other modifications or embodiments as may be suggested by the teachings herein are particularly reserved, especially as they fall within the breadth and scope here appended.

What is claimed is:

1. A bath brush assembly for use in a shower or bath tub comprising:

a frame having a bore extending therethrough, said frame being formed of identical modular components;

a support member joined to an outer surface of the frame, said support member including at least one suction cup for detachably connecting said bath brush assembly to the wall of the shower or bath tub; and a plurality of bristles attached to the frame and extending into the bore whereby a stroke victim or handicapped person may clean an appendage by moving said appendage in the bore.

2. The bath brush assembly as recited in claim 1 wherein the frame is polygon shaped.

3. The bath brush assembly as recited in claim 1 wherein the components are joined using an adhesive.

* * * * *